United States Patent [19]

Quigley

[11] 4,285,172

[45] Aug. 25, 1981

[54] POWER DRIVE APPARATUS FOR TELESCOPIC SEATING SYSTEM

[75] Inventor: Robert E. Quigley, Seymour, Ill.

[73] Assignee: American Seating Company, Grand Rapids, Mich.

[21] Appl. No.: 71,925

[22] Filed: Sep. 4, 1979

[51] Int. Cl.[3] ..... E04H 3/12

[52] U.S. Cl. ..... 52/10; 180/242

[58] Field of Search ..... 52/10, 9; 180/242, 246, 180/251

[56] References Cited

U.S. PATENT DOCUMENTS

| | | | |
|---|---|---|---|
| 1,819,626 | 8/1931 | Scofield | 180/246 X |
| 2,968,842 | 1/1961 | Murphy | 52/10 |
| 3,052,929 | 9/1962 | Busse | 52/10 |
| 3,282,363 | 11/1966 | Curra, Jr. | 52/10 |
| 3,667,171 | 6/1972 | McClelland et al. | 52/9 |
| 3,738,612 | 6/1973 | Hartman | 52/10 |
| 3,872,943 | 3/1975 | Olson | 180/251 |
| 4,041,655 | 8/1977 | Pari | 52/9 |

*Primary Examiner*—Alfred C. Perham

*Attorney, Agent, or Firm*—Emrich, Root, Lee, Brown & Hill

[57] ABSTRACT

Power drive apparatus is adapted for mounting beneath the forward or lower row of a telescopic seating system. The drive apparatus includes a frame which is adapted to be connected to the forward row of the seating system and extend beneath it. A reversible electric motor is mounted centrally of the frame with its axis transverse of the direction of travel of the unit. First and second rollers (as distinguished from wheels or endless track) are mounted to the frame for rotation about respective horizontal forward and rear axes extending transverse of the direction of movement of the rows between the use and storage positions. Each roller has an exterior covering of compressible, resilient material, preferably synthetic rubber. The rollers are preferably located in front of and behind the motor respectively to provide a four-wheel-drive effect. The apparatus fits beneath the deck of the lowest row in the seating system and can easily be retrofitted to an existing system.

8 Claims, 3 Drawing Figures

POWER DRIVE APPARATUS FOR TELESCOPIC SEATING SYSTEM

BACKGROUND OF THE INVENTION

The present invention relates to telescopic seating systems of the type which are used in auditoriums or gymnasiums and which may be moved between an extended or use position in which the rows are in stepped relation, and a retracted or storage position in which the rows are substantially vertically aligned. More particularly, the present invention relates to a power driven system for moving the rows between the extended and the retracted positions.

One type of apparatus used commercially to drive telescopic seating systems of this type is disclosed in the co-owned U.S. Pat. No. 3,738,612 of Hartman. In this type of apparatus, a motor is mounted beneath the rows in a fixed position toward the rear (for a rear folding system), and it is designed to drive a spool about which a chain is wrapped. A rear folding seating system is one in which the rear or highest row is fixed and the lowest row is moved toward the rear during folding. A forward folding system is one in which the lowermost row is fixed and the highest row is moved forward during folding. The chain is comprised of individual sections designed so as to break in one direction for wrapping around the spool, but not to brake in the other direction, and each section is equipped with wheels, the forward section being connected to the lowermost row. When the spool is driven in one direction, the chain is unwound and extends forwardly, thereby extending the seating system, with the individual links moving along the floor and supported by the wheels. When the spool is driven in the other direction, the chain is wrapped about the spool, and pulls the seating system to the retracted position.

Another type of power folding apparatus is disclosed in U.S. Pat. No. 3,052,929 of Busse, granted Sept. 11, 1962. This apparatus includes a power actuator including a driven wheel positioned behind, but moving with and powering the lowermost row in the case of a rear folding seating system. It includes a number of relatively heavy weights to insure traction between the wheels and the floor, and the diameter of the drive wheels is large enough that they cannot fit beneath the deck of the lowermost row.

SUMMARY OF THE INVENTION

The present invention includes a carriage or frame which may have a generally rectangular shape and is adapted to fit almost entirely beneath the deck of the lowermost row. This is considered to be an important advantage in that it permits retrofitting all existing commercial types of systems with the system of the invention, and does not require that the stack of rows be moved forward or inclined slightly in the retractd position, as is the case in some other systems. The present invention can easily be adapted to either a forward folding or a rear folding seating system, but in either case, in the folded position, the apparatus fits substantially entirely beneath the deck of the row to which it is attached.

A reversible electric motor is carried by the carriage at approximately a mid position, and first and second rollers are rotatably mounted to the frame at fore and aft positions. Preferably, the rollers have a compressible, resilient covering made from synthetic rubber or elastomeric material having a high coefficient of friction on wood. These rollers are distinguished from wheels in that their axial extension or dimension is greater than the radius. They are both driven by a common chain drive mechanism connected to the shaft of the reversible electric motor. The motor may be controlled by a pendant which connects to the front of the unit beneath the lowest row.

The carriage is attachable to the exterior of the forward row. This facilitates retrofitting an existing system with the present invention, and it also permits transferring some of the weight of the seating system to the frame or carriage of the power drive system, thereby obviating the need for the heavy weights of the prior art.

The advantages of rollers, as distinguished from wheels or endless track, particularly rollers with coverings of compressible, resilient, high friction material, are that they provide greater traction due to the greater surface contact with the floor, and a much simpler mechanism than endless track. Further, by driving both front and rear rollers, a four-wheel drive effect is obtained to further increase the traction, to provide lateral stability to the row being driven, and to stabilize the drive carriage under load and particularly when obstacles or uneven floor surfaces are encountered by providing both a pushing and a pulling drive force to the carriage. A relatively simple, positive drive mechanism may be used for powering them. Further, by positively driving both of the rollers located respectively in front of and behind the drive motor, substantially all of the motor torque is transmitted to the drive rollers rather than to the structure of the row to which the power apparatus is attached. This obviates a shortcoming for existing commercial systems of the type in which the drive motor moves with the row being driven during folding and unfolding of the seating system.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 1 is a side elevational view, taken from the left, of a portion of a rear-folding telescopic seating system incorporating the present invention, with the rows extended for use; and FIGS. 2 and 3 are close-up front and side views respectively of the power drive unit incorporated into the system of FIG. 1.

DETAILED DESCRIPTION

Figure 1:
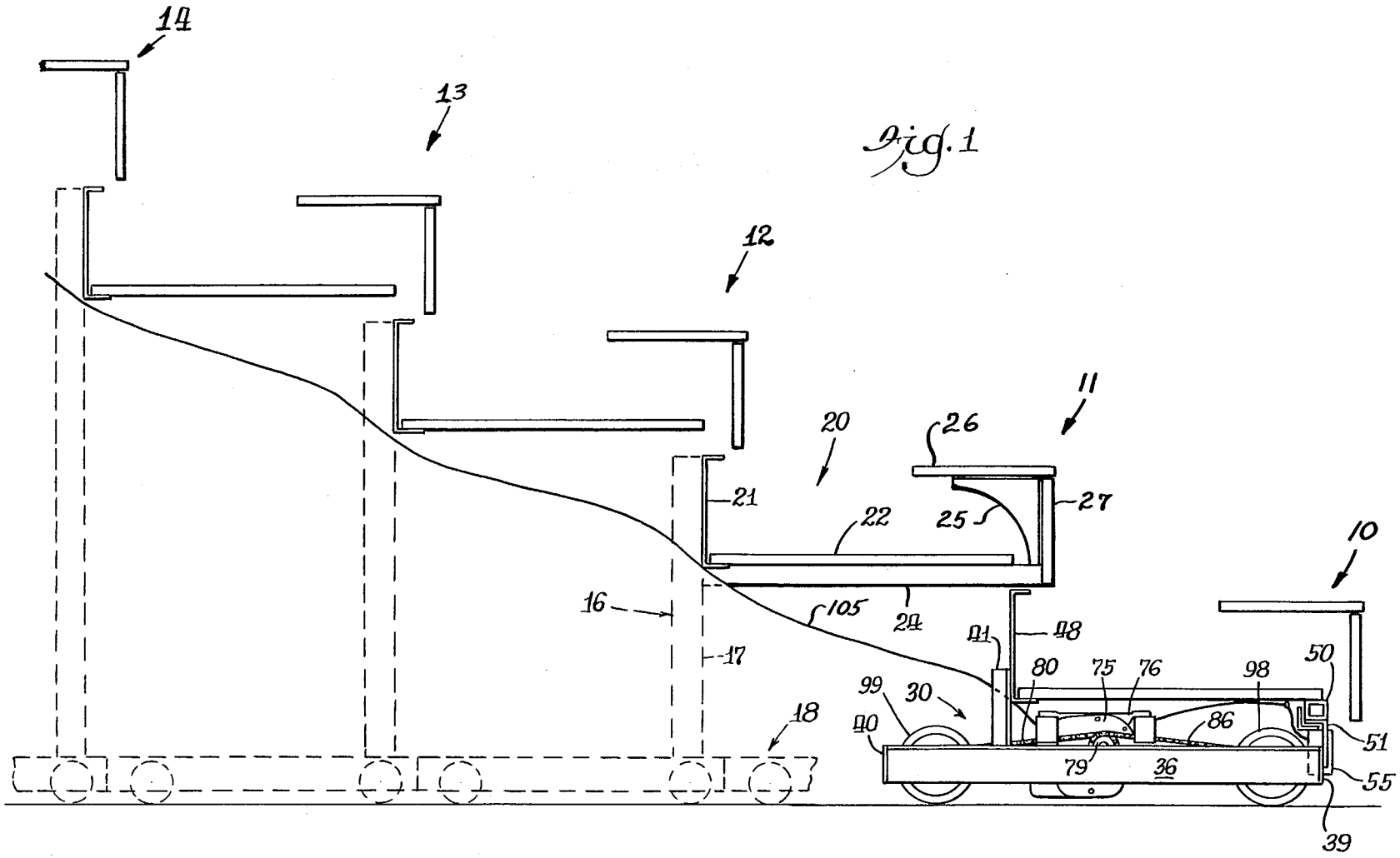

Referring first to FIG. 1, there is seen a telescopic seating system including a plurality of rows, the lowermost or forward row being generally designated by reference numeral 10, and successive higher rows being generally designated 11, 12, 13 and 14. Each of the rows 10–14 are similar in structure. Each row is adapted to be moved between an extended position (the one shown) for use in which the rows are in stepped or tiered relation, and a retracted position for storage in which the rows are generally vertically aligned. In the storage position, each lower row is nested within the next higher row.

Referring to the row 11, it includes a support structure generally designated 16 including a pair of upright support posts, one of which is shown at 17 which are spaced apart progressively as the rows get higher. At the bottom of each support post, there is a wheel carriage generally designated 18 which permits the row to be moved back and forth. A deck generally designated by reference numeral 20 is secured to the top of the support posts 16, and it includes a rear riser of channel shape 21 which is connected to the top of the posts 16, a platform or footrest board 22 having its rear edge supported by the lower flange of the riser 21 and also supported by forwardly extending cantilever arms 24. In this embodiment, seating is in the form of benches mounted to support angles 25 and including a seat board 26 and an upper riser or facia board 27. It is desirable from an aesthetic point of view that all of the facia boards 27 be vertically aligned when the seating is retracted for storage. Additional details can be obtained regarding specific details of the row structure from U.S. Pat. No. 3,667,171 of McClelland and Raymond or, with respect to the under structure, from U.S. Pat. No. 4,041,655 of Pari.

Figure 2:
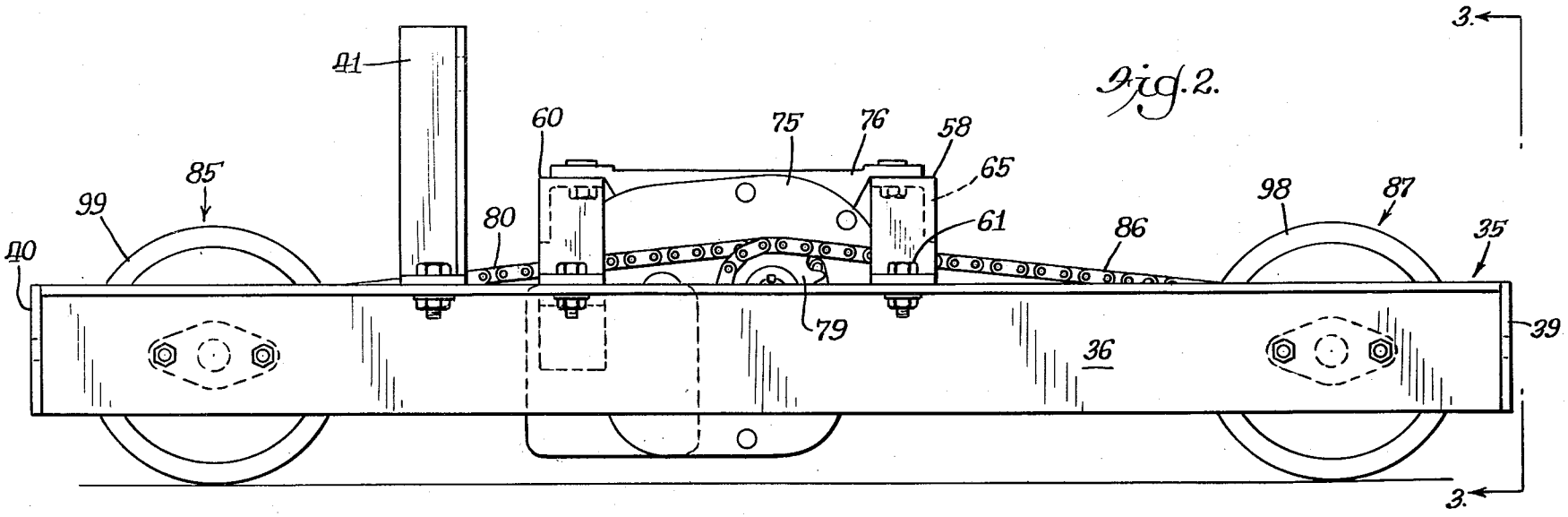
Figure 3:
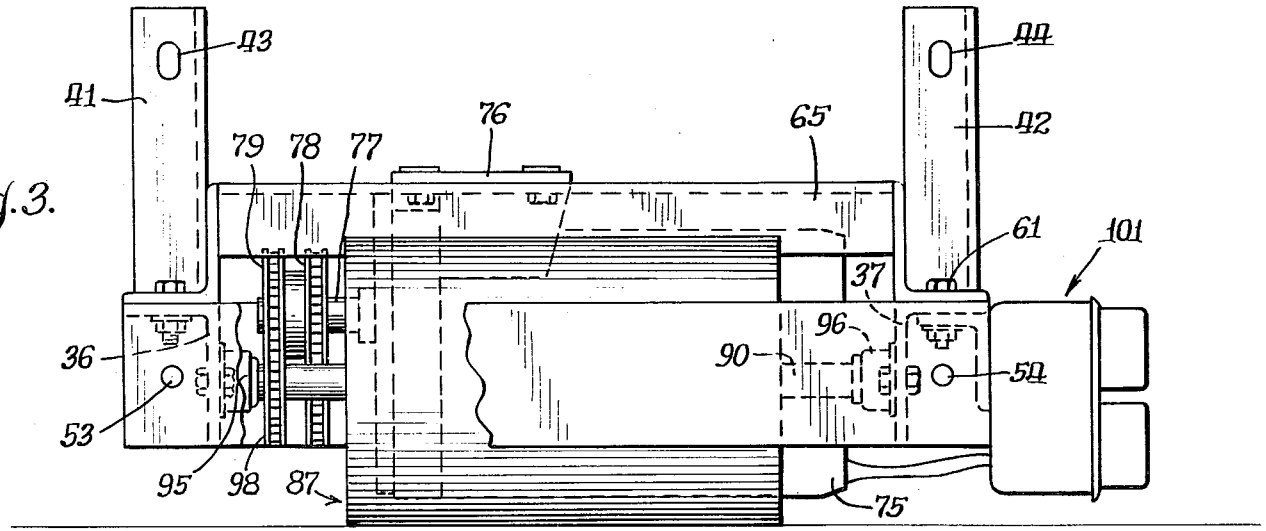

Turning now to the lowermost row 10, the support structure for that row is removed to illustrate a preferred form of a friction drive unit generally designated by reference numeral 30, the details of which are better seen in FIGS. 2 and 3.

Turning then to FIGS. 2 and 3, the friction drive unit includes a carriage or frame generally designated 35 and including first and second side angle members 36, 37 which are formed into a rigid frame with front and rear cross members 39, 40. The first and second upright connector members 41, 42, in the form of angle irons with end flanges, are bolted by means of those end flanges to the side frame members 36, 37 respectively. The upper portions of the connector members 41, 42 are provided with vertically elongated slots 43, 44 respectively for receiving bolts which connect them to the web of the riser 48 of the lowermost row, see FIG. 1. It will be observed that the slots 43, 44 are elongated vertically. This permits adjusting the connection between the riser 48 and the connector members 41, 42 so as to transfer a portion of the weight of the system to the friction drive unit, if desired.

The front of the carriage is connected to a tubular member 50 which, in turn, is connected between the cantilever arms of the lowermost row 10. To accomplish this, a pair of brackets, one of which is designated 51, has a vertical portion connected respectively to one of the apertures 53, 54 in the forward cross frame member 39 of the friction drive unit, and its horizontal flange connected to the front of the tubular frame member 50. Between these two connector brackets there is a receptable 55 into which a pendant switch control, not seen, may be inserted.

The only structural connections between the friction drive unit 30 and the lowermost row 10 are those just described, and it will be observed, therefore, that the unit may be readily retrofitted to an existing structure. Further, because substantially all of the frame is located beneath the deck of the lowermost unit, a minimum of space is taken up when the rows are retracted for storage, and the stack of rows when nested need not be moved forward of a wall to allow room for the unit, as with some prior systems.

Returning now to FIGS. 2 and 3, a front motor mount assembly is generally designated 58, and a rear motor mount assembly is generally designated 60. The motor mount assemblies are connected by means of bolts 61 to the upper horizontal flanges of the side frame members 36, 37. Each of the motor mount assemblies is similar in structure, and includes side angle brackets and a strut, also in the form of an angle iron, such as that designated 65 for the forward motor mount assembly, which is welded to the side angle brackets, the brackets being connected to the side frame members as described.

A reversible electric gear motor 75 is connected by means of a motor mount bracket 76 to the motor mount assemblies just described. The motor 75 may be gear motor Model 5K934, manufactured by W. W. Granger Co. of Chicago, Ill.

As best seen in FIG. 2, a shaft 77 of the motor 75 is provided with first and second sprockets 78, 79. The sprocket 78 is connected by means of a chain 80 to a corresponding sprocket on a rear roller generally designated 85. The sprocket 79 is connected by means of a chain 86 to a forward roller generally designated 87. Each of the rollers 85, 87 is also similar in structure and may be connected to the frame 30 in similar fashion. Turning then to the forward roller 87. It includes a shaft 90 extending from either end thereof and received in side pillow blocks 95, 96 which are, in turn, bolted to the vertical flanges of the side angle members 36, 37 respectively. One end of the shaft 90 is provided with a sprocket (see reference numeral 98 in FIG. 2) about which the chain 86 is entrained. The roller 87 has an exterior covering of synthetic rubber, designated 98. Similarly, the rear roller 85 has a cover 99. In an exemplary embodiment, the rollers 85, 87 may have diameters of approximately 6 inches (including the thickness of the cover), and axial lengths of about 9 inches. The cover material may be nitrile rubber having low carbon and sulfer content, and a hardness or durometer reading of about 45. It is considered important that the cover material have high friction on wood, high abrasion resistance, and low sulphur content (to reduce marking).

The motor 75 may, if desired, be fused directly at the carriage by means of a conventional fuse box designated 101 in FIG. 3.

The operation of the friction drive unit 30 will be apparent to those skilled in the art from the above detailed description. If the motor is operated in a forward direction (either by a pendant switch connected to the receptable 55 or a separate control box mounted to a wall), the rows will be extended for use, and if it is reversed, the rows will be retracted for storage. A flexible line 105 may be run along the rows beneath the decks to supply power to the motor. Limit switches may be provided in the fully extended and fully closed positions to de-energize the motor from further forward or reverse motion respectively. However, it may be better to leave the final positioning at the discretion of the operator. A magnetic reversing contactor may be used to change the polarity of the line signal fed to the motor 75, as is knows in the art.

To summarize the principal advantages of the invention, the use of rollers, as compared with wheels or endless track, increases traction of the friction drive unit. This is particularly so when the rollers are provided with coverings of high friction, low abrasion material, such as that indicated. Further, by driving both the front and the rear roller, a four-wheel drive effect is obtained to further increase the traction and to stabilize the drive unit under load, particularly when obstacles are encountered or the unit travels over an uneven floor surface, due to the fact that the forward roller pulls the unit, whereas the rear roller exerts a pushing force on the carriage. On the other hand, if an obstacle is encountered which cannot be overcome, the friction drive rollers will slip on the floor and thereby avoid damage to the system.

Having thus described in detail a preferred embodiment of the invention, persons skilled in the art will be able to modify certain of the structure which has been disclosed and to substitute equivalent elements for those illustrated while continuing to practice the principle of the invention; and it is, therefore, intended that all such modifications and substitutions be covered as they are embraced within the spirit and scope of the appended claims.

I claim:

1. Friction drive apparatus for a telescopic seating system having a plurality of rows adapted for movement between an extended position in which the rows are in stepped relation and a retracted position in which the rows are substantially vertically aligned, comprising: a frame; a motor carried by said frame; means for mounting said frame to one row of said system; first and second rollers mounted to said frame for rotation about respective forward and rear horizontal axes extending transverse of the direction of movement of said rows between said positions, each roller having an axial extension greater than its radius and an outer surface of resilient friction material; and positive drive means for connecting said rollers to said motor for being driven thereby.

2. The apparatus of claim 1 wherein said apparatus is connected to the lowermost row in a rear folding system.

3. The apparatus of claim 2 wherein the shaft of said motor is located approximately midway between the axes of said rollers, and characterized in that a major portion of said drive apparatus is received beneath the deck of the row to which it is connected.

4. The apparatus of claim 2 wherein said means for connecting said frame to said row includes vertically adjustable connector means whereby a portion of the weight of the row to which the apparatus is connected may be transferred to the apparatus.

5. The apparatus of claim 4 wherein said connector means includes forward connector means for connecting the front of said frame to the forward portion of an associated deck of said row; and a rear connector means for connecting said frame to the rear portion of said deck.

6. The apparatus of claim 1 wherein said outer surface material of said rollers is selected from the class consisting of rubber and elastomeric material.

7. The apparatus of claim 1 wherein the axial length of each of said rollers is about three times its radius.

8. The apparatus of claim 7 wherein said positive drive means includes an axle journalled in said frame for each roller, a sprocket on each axle, sprocket means on the output shaft of said motor, and chain means driven by said sprocket means and connected to each of said axle sprockets.

* * * * *